US006921070B2

(12) United States Patent
Berti et al.

(10) Patent No.: US 6,921,070 B2
(45) Date of Patent: Jul. 26, 2005

(54) METHOD AND DEVICE FOR FEEDING SHEETS TO A PRINTING-TECHNOLOGY MACHINE

(75) Inventors: Christopher Berti, Dielheim (DE); Bernhard Buck, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 166 days.

(21) Appl. No.: 10/298,428

(22) Filed: Nov. 18, 2002

(65) Prior Publication Data

US 2003/0094747 A1 May 22, 2003

(30) Foreign Application Priority Data

Nov. 16, 2001 (DE) ..... 101 56 107

(51) Int. Cl.[7] ..... B65H 9/06
(52) U.S. Cl. ..... 271/264; 271/246
(58) Field of Search ..... 271/264, 226, 271/227, 245, 253, 254, 265.01, 246, 258.01; 101/232, 484

(56) References Cited

U.S. PATENT DOCUMENTS 4,458,893 A 7/1984 Ruh
4,895,361 A * 1/1990 Fujii et al. ..... 271/253
5,761,998 A * 6/1998 Fricke et al. ..... 101/232
6,000,694 A 12/1999 Krüger et al.
6,241,241 B1 6/2001 Fricke et al.
6,283,471 B1 * 9/2001 Kunzel et al. ..... 271/227
6,349,935 B1 * 2/2002 Boguhn et al. ..... 271/265.01

FOREIGN PATENT DOCUMENTS

DE 31 38 540 A1 4/1983
DE 42 39 254 A1 * 5/1994 ..... B65H/9/04
DE 42 43 585 A1 6/1994
DE 44 21 199 A1 * 12/1995 ..... B41F/21/12
DE 196 16 755 A1 11/1997
DE 199 01 699 A1 8/1999

* cited by examiner

*Primary Examiner*—Donald P. Walsh
*Assistant Examiner*—Mark J. Beauchaine
(74) *Attorney, Agent, or Firm*—Laurence A. Greenberg; Werner H. Stemer; Ralph E. Locher

(57) ABSTRACT

A method of feeding sheets to a printing-technology machine includes individually separating sheets from a sheet pile, conveying the sheets against movable lays for effecting an alignment thereof, and cyclically conveying the sheets from the lays to the machine. A control device coordinates movement of the lays with the individual separation of the sheets from the sheet pile and onward conveyance of the sheets to the machine. Data related to characteristics of the sheets are processed in the control device for generating actuating signals for a separate, controllable drive system. The lays are moved by the drive system. A device for performing the method is also provided.

9 Claims, 3 Drawing Sheets

METHOD AND DEVICE FOR FEEDING SHEETS TO A PRINTING-TECHNOLOGY MACHINE

BACKGROUND OF THE INVENTION

Field of the Invention

The invention relates to a method and a device for feeding sheets to a machine pertinent to printing technology or, in short, a printing-technology machine.

In printing presses, sheets from a sheet pile or stack are conveyed individually or in overlapped form against feed lays on a feed table set at an angle thereto. The feed lays may be formed as front and top lays, the top lays serving to catch a sheet to be aligned, and the front lays forming a feed line for aligning the sheets at the leading edge thereof. In order to move the feed lays from the operating position thereof into a position underneath the feed table, in a construction shown in German Published, Non-prosecuted Patent Application DE 42 43 585 A1, the feed lays are disposed on coupling rods of four-bar linkages constructed as double swinging arms. A drive element of the four-bar linkage is coupled to the drive of the printing press. The top lays can be set to the thickness of the sheets being advanced for processing.

In German Published, Non-prosecuted Patent Application DE 199 01 699 A1, corresponding to U.S. Pat. No. 6,241,241, a method of eliminating rhythmic register faults in sheet-fed rotary presses is described, wherein front lays can be moved into two different alignment positions on a feed table by being pivoted from a position outside the conveying path of the sheets by a cyclically driven shaft. The pivoting movement of the front lays is controlled via a cam mechanism which is connected to the main drive of the sheet-fed printing press.

In a drive for a swinging pregripper in a sheet-fed printing press shown in German Published, Non-prosecuted Patent Application DE 196 16 755 A1, corresponding to U.S. Pat. No. 6,000,694, additional acceleration and braking torques are introduced with the aid of a linear drive. The drive for the reciprocating movement can therefore be load-relieved.

In all the aforementioned constructions, the movements of the lays or gripper systems are controlled by mechanical elements which have a connection to the main drive of the printing-technology machine. The mechanical drive elements are subjected to fixed movement sequences, so that an adaptation to different conveying speeds and sheet thicknesses is able to be carried out only with increased effort.

As shown and described in German Published, Non-prosecuted Patent Application DE 31 38 540 A1, corresponding to U.S. Pat. No. 4,458,893, a device for feeding sheets separated on a feed table and aligned according to the leading and side edge is provided with a computer for evaluating rotary encoder signals. The computer serves for driving a motor for a feed cylinder which, for transferring a sheet, is moved cyclically from a minimum circumferential speed or from a standstill to the circumferential speed of a printing-press cylinder. The drive for the sheet feed device is separated from the other printing-press drive. The alignment of the sheets on the leading and side edge is performed in a conventional manner.

SUMMARY OF THE INVENTION

It is accordingly an object of the invention to provide a method and a device for feeding sheets to a printing-technology machine, which overcome the hereinafore-mentioned disadvantages of the heretofore-known methods and devices of this general type and which permit flexible adaptation to machine and process conditions, with little outlay.

With the foregoing and other objects in view, there is provided, in accordance with the invention, a method of feeding sheets to a printing-technology machine, which comprises individually separating sheets from a sheet pile. The sheets are conveyed against movable lays for effecting an alignment thereof. The sheets are cyclically conveyed from the lays to the machine. A control device coordinates movement of the lays with the individual separation of the sheets from the sheet pile and onward conveyance of the sheets to the machine. Data related to characteristics of the sheets for generating actuating signals for a separate, controllable drive system are processed in the control device. The lays are moved by the drive system.

In accordance with another mode, the method of the invention further includes additionally processing data containing information relating to at least one of machine speed, machine configuration and a then occurring machine process, in the control device.

With the objects of the invention in view, there is also provided a device for feeding sheets to a printing-technology machine, comprising a device for individually separating sheets from a sheet pile. A conveying device is used for conveying the individually separated sheets against liftable and lowerable lays. Drive elements are provided for lifting and lowering the lays. A further conveying device is present for conveying the individually separated sheets from the lays to the machine. At least one control device is connected to the separating device and to the conveying devices for setting a course of movement of the lays based upon characteristics of the sheets. Equipment is provided for feeding data relating to the sheet characteristics to the control device for lifting and lowering the lays.

In accordance with an added feature of the invention, the data-feeding equipment serves for additionally feeding data relating to at least one of printing speed, machine configuration and a then occurring machine process to the control device for lifting and lowering the lays.

In accordance with an additional feature of the invention, the sheet-feeding device further includes an electric motor for actuating the drive elements for lifting and lowering the lays.

In accordance with yet another feature of the invention, the motor is coupled directly with a shaft whereon the lays are disposed.

In accordance with yet a further feature of the invention, the shaft is coupled with a rotary encoder connected to the control device for lifting and lowering the lays.

In accordance with yet an added feature of the invention, the lays are disposed on a shaft, and the motor is a linear motor coupled via a pivoting lever with the shaft for lifting and lowering the lays.

In accordance with a concomitant feature of the invention, the sheet-feeding device further includes a gear transmission provided between the lays and the motor for lifting and lowering the lays.

Due to the fact that the lays are moved by a separate, controllable drive system, it is possible to adapt the time available for aligning and stabilizing a sheet continuously to the then occurring machine speed. The feed register is thereby improved. The lays are able to be positioned with small drive torques, due to which the excitation to oscillations is reduced. The movement of the lays can be controlled so that no mechanical damage to the sheet and no formation of waves in the sheet occur.

In printing-technology machines with front and top lays, a preferably electromotive drive is provided therefor which is independent of the rest of the machine, that can be subjected to different courses of movement by an open-loop and closed-loop control device. In order to determine a then occurring course of movement, information relating to the sheet characteristics, the machine speed, the machine configuration and the machine process is processed in the open-loop and closed-loop control device. The information can be entered manually, taken from a memory or obtained by detectors. For example, a sensitive board, i.e., cardboard or pasteboard or the like, in a printing press having a large number of printing units requires a course of movement for the lays wherein the risk of scratching a sheet by the lays is reduced at the expense of the feed register and the excitation to oscillations. If, by contrast, thin paper is to be processed, a course of movement will then be provided which as much as possible prevents the formation of waves in the incoming sheet. In a machine having a small number of printing units, the course of movement is optimized so that the feed register is improved and the stabilizing time of the sheet is lengthened. In machines having a large number of printing units, these criteria are not important, because a sheet can be printed in final form in a single pass. The courses of movement of the lays can also be coordinated with the courses of movement of the sheet conveying devices disposed upstream and downstream, in particular if those sheet conveying devices are likewise driven separately.

Other features which are considered as characteristic for the invention are set forth in the appended claims.

Although the invention is illustrated and described herein as embodied in a method and a device for feeding sheets to a printing-technology machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 2.2 is a front-elevational and schematic view of FIG. 2.1; and

DESCRIPTION OF THE PREFERRED EMBODIMENTS

Figure 1:
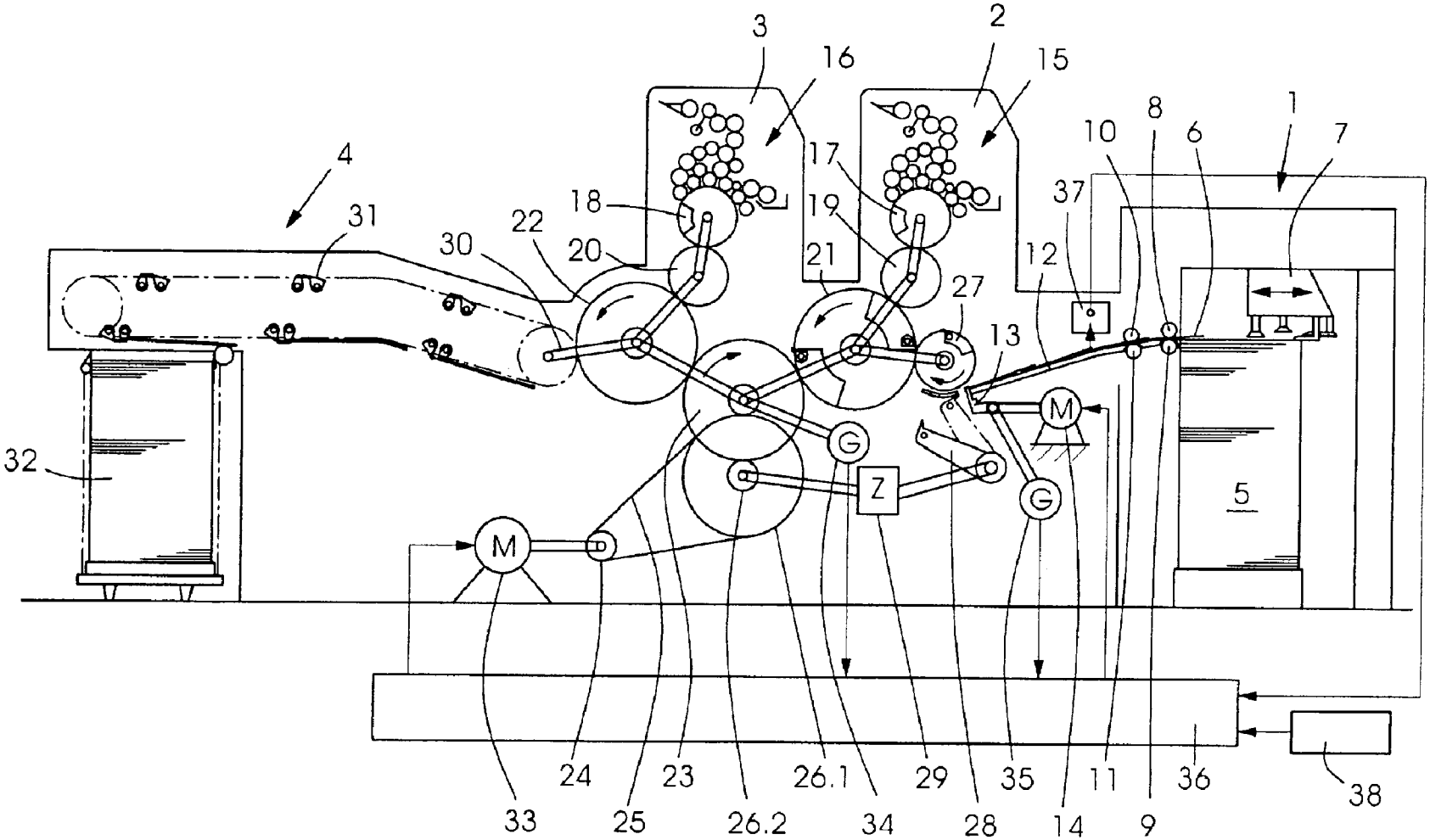
FIG. 1 is a diagrammatic and schematic view of a printing press having a device for performing the method according to the invention.

Referring now to the figures of the drawings in detail and first, particularly, to FIG. 1 thereof, there is seen a printing press having a feeder 1, two printing units 2 and 3, and a delivery 4. A sheet pile or stack 5 of sheets 6 which is provided in the feeder 1 can be separated individually or singly from above by a suction head 7. The uppermost sheet 6 is lifted off the stack 5 by the suction head 7 and fed to transport rollers 8 to 11. The transport rollers 8 to 11 and non-illustrated transport belts convey the sheets 6 individually and successively, in underlapped form, on a feed table against front lays 13. The front lays 13 are pivotable from a working position, as illustrated, into a position underneath the feed table 12 with the aid of a motor 14. The first and second printing units 2 and 3, respectively, have inking and dampening rollers 15, 16, a plate cylinder 17, 18, a transfer cylinder 19, 20 and an impression cylinder 21, 22, which are all coupled via a gear train. Connected between the impression cylinders 21, 22 is a transfer drum 23, which is drivable by a belt drive 24 to 26.1 and a gear 26.2. A feed drum 27 is assigned to the impression cylinder 21. An oscillating or swinging gripper 28 which is provided in order to convey the sheets 6 from the front lays 13 to the feed cylinder 27, is coupled to the gear 26.2 via a transmission or gearbox 29. The cylinders and drive elements which are coupled to one another via the aforedescribed gear train are connected, respectively, by a double line 30 in FIG. 1. In the delivery 4, there is a chain gripper system 31, which conveys the finally printed sheets 6 from the impression cylinder 22 onto a delivery pile or stack 32. A main drive motor 33 is coupled to the belt drive 24 for driving the printing press. A rotary encoder 34 is provided in the gear train of a transfer drum 23 for determining or registering the rotational angle. The pivoting movement of the front lays 13 is determined or registered by a further rotary encoder 35. The drive of the front lays 13 has no mechanical connection to the main drive train of the printing press. The motors 14, 33 for the front lays 13 and the main drive of the printing press, and the rotary encoders 34, 35 are connected to a control device 36. In the sheet path over the feed table 12, there is disposed a sensor unit 37 for detecting characteristics of the sheets 6, such as sheet thickness, format, weight, weight distribution, moisture content and the like. The sensor unit 37 is connected to the control device 36. Also connected to the control device 36 is an input unit 38 for information relating to the sheet characteristics, the machine configuration and the transpiring machine process. The input unit 38 permits entry of the information by an operator, by transfer from a memory or as an interface to sensors for the information concerning the machine process, such as the then existing register deviations, for example.

Figure 2:
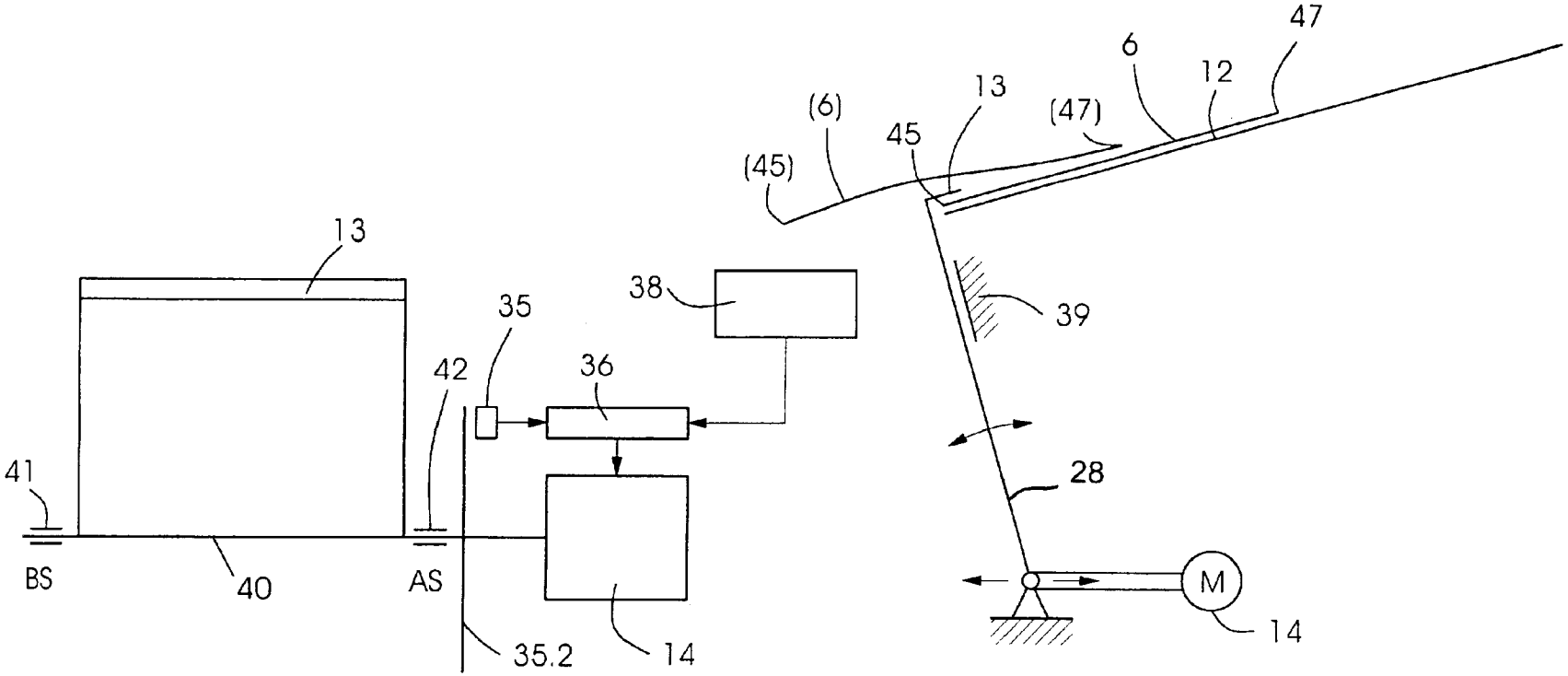
FIG. 2.1 is a fragmentary, highly diagrammatic side-elevational view of FIG. 1, showing front lays.

FIGS. 2.1 and 2.2 show details from the range of action of the front lays 13. According to FIG. 2.1, the front lays 13 in the working position rest against a stop 39 underneath the feed table 12. In the working position, the front lays 13 form a stop line for an oncoming sheet 6, while a previously arrived sheet 6 is being conveyed over the front lays 13 to the feed drum 27 by the oscillating gripper 28. As shown in FIG. 2.2, the front lays 13 on the drive side AS and on the operating side BS of the printing press are held with a pivot shaft 40 in bearings 42 and 41, respectively, the pivot shaft 40 being coupled directly to the motor 14. Starting from the working position, the front lays 13 can be moved reciprocatingly over an angular range of about 50° by the motor 14. In order to determine or register the rotational position, a screen disk 35.2 belonging to the rotary encoder 35 is fixed to the pivot shaft 39.

From the information relating to the sheet characteristics and from the additional information relating to the machine speed, the machine configuration and the machine process, the optimum course of movement for the front lays 13 is determined in the control device 36 with the aid of a computer. Appropriate signals are fed to the motor 14, so that the front lays 13 assume a calculated rotational position in the pivoting range in accordance with the machine angle determined by the rotary encoder 34.

When the sheets 6 are thin, they are unstable and, when being conveyed from the front lays 13 to the feed drum 27, they cling readily to the prescribed construction space. The risk that the thin sheets 6 will come into contact with machine, i.e., press, parts and will be scratched is quite low, when compared with thick, and therefore rigid, grammage. When thin sheets 6 are being conveyed from the front lays 13 to the feed drum 27, it is sufficient for those sheets to be supported by conventional sheet guide elements, which can be constructed in the form of a rake. Additional support by the front lays 13 during the onward movement thereof from the stop 39 is not required. However, because of the instability of the thin sheets 6, they are difficult to align on the front lays 13. The motor 14 is therefore controlled in a manner that the front lays 13 arrive early into the working position thereof at the stop 39, and therefore a greater time interval is available for aligning thin sheets. During the relatively long dwell time of a thin sheet 6 on the front lays 13, the sheet 6 comes to rest in terms of movement, which consequently improves the alignment in the conveying direction and in the lateral direction, and the sheet 6 can be gripped exactly by the oscillating gripper 28.

When the sheets 6 are thick, they are rigid and heavy and, when being conveyed from the front lays 13 to the feed drum 27, need additional support from the front lays 13, which are of non-scratching construction, while the front lays 13 are moving onward from the stop 39. This prevents the thick sheet 6 from colliding with other machine parts. Due to the great rigidity of the thick sheet 6, the alignment thereof on the front lays 13 is not critical. The motor 14 serves for moving the front lays in a manner that they dwell on the stop 39 for only a short time, and as much time as possible is available for supporting the thick sheet 6.

During the conveyance of sheets 6 having a small format, and being formed of very rigid board, the motor 14 is driven in a manner that the front lays 13 follow the sheet trailing edge 47.

Figure 3:
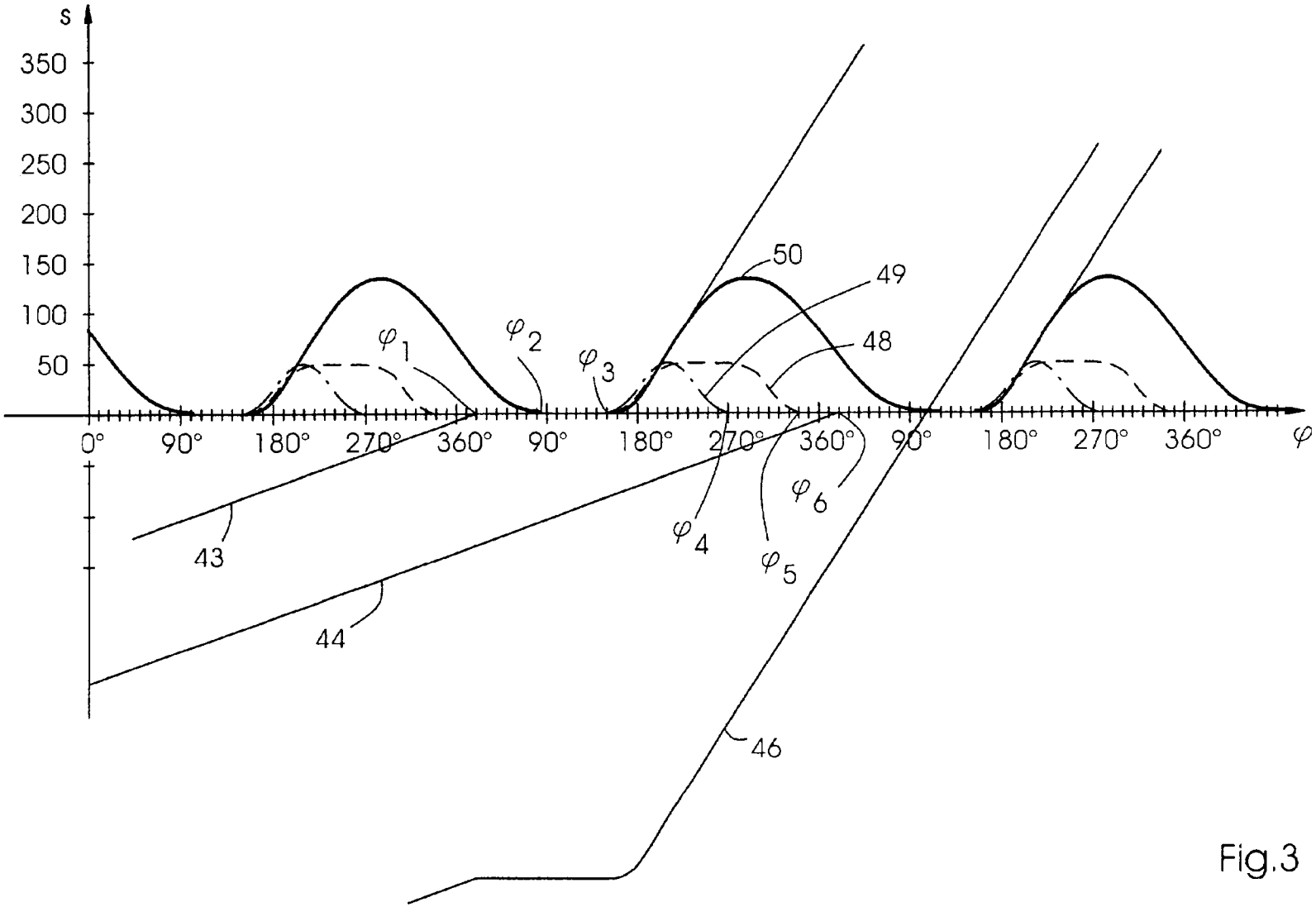
FIG. 3 is a plot diagram of the sheet travel distance with respect to the machine angle in degrees, thereby depicting the course of movement of the front lays.

The course of movement for two sheets 6 is illustrated in FIG. 3. In the ordinate direction, the plot diagram or graph of FIG. 3 shows the machine angle $\phi$ which results from the signals transmitted by the rotary encoder 34. The sheet travel path s is plotted in the abscissa direction. The sheet travel path s is 0 when the sheet 6 rests aligned on the front lays 13. The curves 43 and 44 show the path of the leading edge 45 of a first and a second sheet 6, respectively. The curve 46 shows the path of the trailing edge 47 of the first sheet 6.

The curve 46 lies parallel to parts of the curves 43 and 44. The distance between the curves 43 and 46 represents the sheet length L of the first sheet 6. The curves 48 and 49 show the paths of the front lays 13 with two different sheet thicknesses. Curve 50 shows the course of the movement of the oscillating gripper 28.

According to curve 43, the first sheet 6 is conveyed with uniform speed against the front lays 13 and reaches the stationary front lay 13 at the machine angle $\phi_1$. At a machine angle $\phi_2$, the oscillating gripper 28 reaches the leading edge 45 of the first sheet 6. The first sheet 6 is gripped by the swinging gripper 28. As far as a machine angle $\phi_3$, the leading edge 45 of the first sheet 6 is located in the oscillating gripper 28 and on the front lays 13. Starting from the angle $\phi_3$, the front lays 13 are pivoted away from the working position of the stop 39 by the motor 14. The front lays 13 open the path for the transport of the first sheet 6 to the feed cylinder 27 by the oscillating gripper 28.

Depending upon the sheet thickness, the front lays 13 are again moved into the working position either earlier or later. According to the curve 49, the front lays 13 already reach the working position at the machine angle $\phi_4$. This course of movement is advantageous for thinner sheets 6. In the case of thick sheets 6 such as board, the course of movement is set in accordance with the curve 48. The front lays 13 reach the working position only at the machine angle $\phi_5$, but yet in sufficient time to receive the next sheet 6. As FIG. 3 illustrates, the leading edge 45 of the second sheet 6 reaches the front lay 13 at the angle $\phi_6$. The further courses of movement are repeated as described hereinabove with respect to the first sheet 6.

In an alternative non-illustrated embodiment, the pivot or swing shaft 39 is pivoted by a linear motor and a lever mechanism. In principle, the setting of the courses of movement remains the same. The embodiment in terms of construction depends upon the available construction space.

The method serves both for the front lays 13 and for top lays. The top lays can likewise be driven by separate actuators. The movement of the top lays is not a pure pivoting movement, but rather, a lifting and pivoting movement, for which purpose two actuators, such as rotating or linear electric motors, for example, can serve.

The invention of the instant application is applicable not only for a direct coupling between an actuator and a front lay 13 or top lay. Gear mechanisms, such as cams or coupling mechanisms, can be connected between an actuator and a drive element of a lay. By such a gear mechanism, parts of the course of movement of the lays can be defined or determined, for example, a lifting movement or a pivoting movement in a defined angular range. When a gear mechanism is applied for moving lays, the method according to the invention is realized by a non-uniform drive of the gear mechanism, so that the same movement path of a lay is traversed with a variable time pattern.

We claim:

1. A method of feeding sheets to a printing-technology machine, which comprises:

individually separating sheets from a sheet pile;

conveying the sheets against movable lays for effecting an alignment of the sheets;

cyclically conveying the sheets from the lays to the machine;

coordinating movement of the lays with the individual separation of the sheets from the sheet pile and onward conveyance of the sheets to the machine, with a control device;

processing data related to characteristics of the sheets, in the control device, for generating actuating signals for a separate, controllable drive system; and moving the lays with the drive system, in accordance with said processing signals.

2. The method according to claim 1, which further comprises additionally processing, in the control device, data containing information relating to at least one of machine speed, machine configuration and a then occurring machine process.

3. A device for feeding sheets to a printing-technology machine, comprising:

a device for individually separating sheets from a sheet pile;

lays to be lifted and lowered;

a conveying device for conveying the individually separated sheets against said lays;

drive elements for lifting and lowering said lays;

a further conveying device for conveying the individually separated sheets from said lays to the machine;

at least one control device connected to said separating device and to said conveying devices for setting a course of movement of said lays based upon characteristics of the sheets; and equipment for feeding data relating to said sheet characteristics to said control device for lifting and lowering said lays.

4. The sheet-feeding device according to claim 3, wherein said data-feeding equipment serves for additionally feeding data relating to at least one of printing speed, machine configuration and a then occurring machine process to said control device for lifting and lowering said lays.

5. The sheet-feeding device according to claim 3, further comprising an electric motor for actuating said drive elements for lifting and lowering said lays.

6. The sheet-feeding device according to claim 5, further comprising a shaft, said lays being disposed on said shaft, and said motor being coupled directly with said shaft.

7. The sheet-feeding device according to claim 6, further comprising a rotary encoder connected to said control device for lifting and lowering said lays, said shaft being coupled with said rotary encoder.

8. The sheet-feeding device according to claim 5, further comprising a pivoting lever, and a shaft, said lays being disposed on said shaft, and said motor being a linear motor coupled via said pivoting lever with said shaft for lifting and lowering said lays.

9. The sheet-feeding device according to claim 5, further comprising a gear transmission provided between said lays and said motor for lifting and lowering said lays.

* * * * *